US006616801B1

(12) United States Patent
Boyd

(10) Patent No.: US 6,616,801 B1
(45) Date of Patent: Sep. 9, 2003

(54) METHOD AND APPARATUS FOR FIXED-ABRASIVE SUBSTRATE MANUFACTURING AND WAFER POLISHING IN A SINGLE PROCESS PATH

(75) Inventor: John M. Boyd, Atascadero, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 09/541,109

(22) Filed: Mar. 31, 2000

(51) Int. Cl.[7] ..... H01L 2/302; C23F 1/00

(52) U.S. Cl. ..... 156/345.12; 451/56; 451/443; 451/444; 451/539

(58) Field of Search ..... 451/56, 443, 444, 451/539; 438/692, 693; 216/88, 89; 156/345.12

(56) References Cited

U.S. PATENT DOCUMENTS

| | | | | |
|---|---|---|---|---|
| 3,753,269 | A | 8/1973 | Budman | 15/160 |
| 4,318,250 | A | 3/1982 | Klievoneit et al. | 51/134 |
| 4,720,939 | A | 1/1988 | Simpson et al. | 51/135 R |
| 5,014,468 | A | 5/1991 | Ravipati et al. | |
| 5,081,051 | A | 1/1992 | Mattingly et al. | 437/10 |
| 5,104,421 | A | 4/1992 | Takizawa et al. | |
| 5,197,999 | A | 3/1993 | Thomas | |
| 5,257,478 | A | 11/1993 | Hyde et al. | |
| 5,335,453 | A | 8/1994 | Baldy et al. | 51/67 |
| 5,484,323 | A | 1/1996 | Smith | 451/10 |
| 5,531,635 | A | 7/1996 | Mogi et al. | |
| 5,536,202 | A | 7/1996 | Appel et al. | 451/285 |
| 5,547,417 | A | 8/1996 | Breivogel et al. | 451/58 |
| 5,558,568 | A | 9/1996 | Talieh et al. | 451/303 |
| 5,575,707 | A | 11/1996 | Talieh et al. | 451/173 |
| 5,593,344 | A | 1/1997 | Weldon et al. | 451/296 |
| 5,611,943 | A | 3/1997 | Cadien et al. | 216/88 |

(List continued on next page.)

FOREIGN PATENT DOCUMENTS

| | | |
|---|---|---|
| JP | 63-267155 | 2/1989 |
| WO | WO 97/11484 | 3/1997 |
| WO | WO 98/45090 | 10/1998 |
| WO | WO 99/22908 | 5/1999 |

OTHER PUBLICATIONS

U.S. patent application No. 09/540,385: "Method and Apparatus for Chemically–Mechanically Polishing Semiconductor Wafers" Inventor: Glen Travis, et al., Filing Date: Mar. 31, 2000 Attorney Docket No. 7103–123.

U.S. patent application application No. 09/541,144: "Method and Apparatus for Chemical Mechanical Planarization and Polishing of Semiconductor Wafers Using a Continuous Polishing Member Feed"—Inventors: Ben Mooring, et al., Filed: Mar. 31, 2000 Attorney Docket No. 7103–165.

Database WPI printout, Section PR, Weekly, "XP–002172706", dated Jul. 18, 1986, 1 page.

Copy of PCT Search Report for corresponding patent application PCT/US01/09887, filed on Mar. 28, 2001 and dated Aug. 6, 2001, 7 pages.

U.S. Patent Application Ser. No. 09/607,743 A Conditioning Mechanism in a Chemical Mechanical Polishing Apparatus for Semiconductor Wafers Filing Date: Jun. 30, 2000 Attorney Docket No. 7103–173.

U.S. Patent Application Ser. No. 09/540,810 Fixed Abrasive Linear Polishing Belt and System—Inventors: Zhao et al. Filing Date: Mar. 31, 2000 Attorney Docket No. 7103–135.

*Primary Examiner*—George Goudreau
(74) *Attorney, Agent, or Firm*—Brinks Hofer Gilson & Lione

(57) ABSTRACT

Methods and apparatus are provided for combining the manufacturing of a fixed-abrasive substrate and the chemical mechanical planarization of semiconductor wafers using a single process path.

13 Claims, 4 Drawing Sheets

U.S. PATENT DOCUMENTS 5,622,526 A 4/1997 Phillips ..... 451/72
5,643,044 A 7/1997 Lund ..... 451/5
5,655,951 A 8/1997 Meikle et al. ..... 451/56
5,674,122 A * 10/1997 Krech ..... 451/536
5,692,947 A 12/1997 Talieh et al. ..... 451/41
5,692,950 A 12/1997 Rutherford et al. ..... 451/552
5,725,417 A 3/1998 Robinson
5,759,918 A 6/1998 Hoshizaki et al. ..... 438/692
5,762,536 A 6/1998 Pant et al. ..... 451/6
5,810,964 A 9/1998 Shiraishi
5,871,390 A 2/1999 Pant et al. ..... 451/5
5,897,426 A 4/1999 Somekh ..... 451/41
5,899,798 A 5/1999 Trojan et al. ..... 451/259
5,908,530 A 6/1999 Hoshizaki et al. ..... 156/345
5,921,853 A 7/1999 Nushio
5,958,794 A 9/1999 Bruxvoort et al. ..... 438/692
6,299,508 B1 * 10/2001 Gagliardi et al. ..... 451/28
6,306,019 B1 10/2001 Finkelman
6,361,414 B1 3/2002 Ravkin et al.
6,435,952 B1 8/2002 Boyd et al.

* cited by examiner

METHOD AND APPARATUS FOR FIXED-ABRASIVE SUBSTRATE MANUFACTURING AND WAFER POLISHING IN A SINGLE PROCESS PATH

FIELD OF THE INVENTION

The present invention relates to the chemical mechanical planarization of semiconductor wafers using a fixed abrasive substrate. More particularly, the present invention relates to an improved system and method for chemical mechanical planarization in which the manufacturing of the fixed abrasive substrate occurs in situ, being incorporated into the same process path as the chemical mechanical planarization process.

BACKGROUND OF THE INVENTION

Semiconductor wafers are commonly constructed in layers, where a portion of a circuit is created on a first level and conductive vias are made to connect up to the next level of the circuit. After each layer of the circuit is etched on the wafer, an oxide layer is put down allowing the vias to pass through but covering the rest of the previous circuit level. Each layer of the circuit can create or add unevenness to the wafer that must be smoothed out before generating the next circuit layer.

Chemical mechanical planarization (CMP) techniques are used to smooth or planarize the raw wafer and each layer of material added thereafter. Available CMP systems, commonly called wafer polishers, often use a rotating wafer holder that brings the wafer into contact with a polishing pad rotating in the plane of the wafer surface to be planarized. A planarization liquid or CMP slurry is applied to the polishing pad to facilitate the removal of material from the surface of the wafer.

The polishing pad may utilize a loose or a fixed abrasive. In the case of a loose abrasive, the polishing pad is generally made from a nonabrasive material, and the planarization liquid is generally a CMP slurry containing abrasive particles and chemicals that remove material from the surface of the wafer. In the case of a fixed abrasive, the polishing pad is generally made from a mixture of abrasive particles in a binding agent affixed to a backing or substrate, and the planarization liquid generally does not contain abrasive particles.

The fixed-abrasive substrate can be produced in any form that can be used in a CMP polishing process. A variety of forms are commonly used, including a continuous roll, a closed loop, annular disks, and round disks. With respect to the CMP process, the fixed-abrasive substrates are generally considered consumable products. Fixed-abrasive substrates are usually purchased from a third party supplier and are very expensive. One example of such a fixed-abrasive substrate is produced by 3M and distributed by Rodel.

SUMMARY

In one aspect, the present invention provides methods and apparatus for combining the manufacturing of a fixed-abrasive substrate and the chemical mechanical planarization of semiconductor wafers using a single process path.

In another aspect, the present invention provides methods and apparatus which allow both continuous fixed-abrasive substrate manufacturing and continuous wafer polishing using a single process path.

In another aspect, the present invention provides methods and apparatus for combined manufacturing of a fixed-abrasive substrate and wafer polishing where the components of the fixed-abrasive substrate can be reclaimed and recycled for further use in a fixed-abrasive substrate manufacturing process.

DETAILED DESCRIPTION OF THE PRESENTLY PREFERRED EMBODIMENTS

Figure 1:
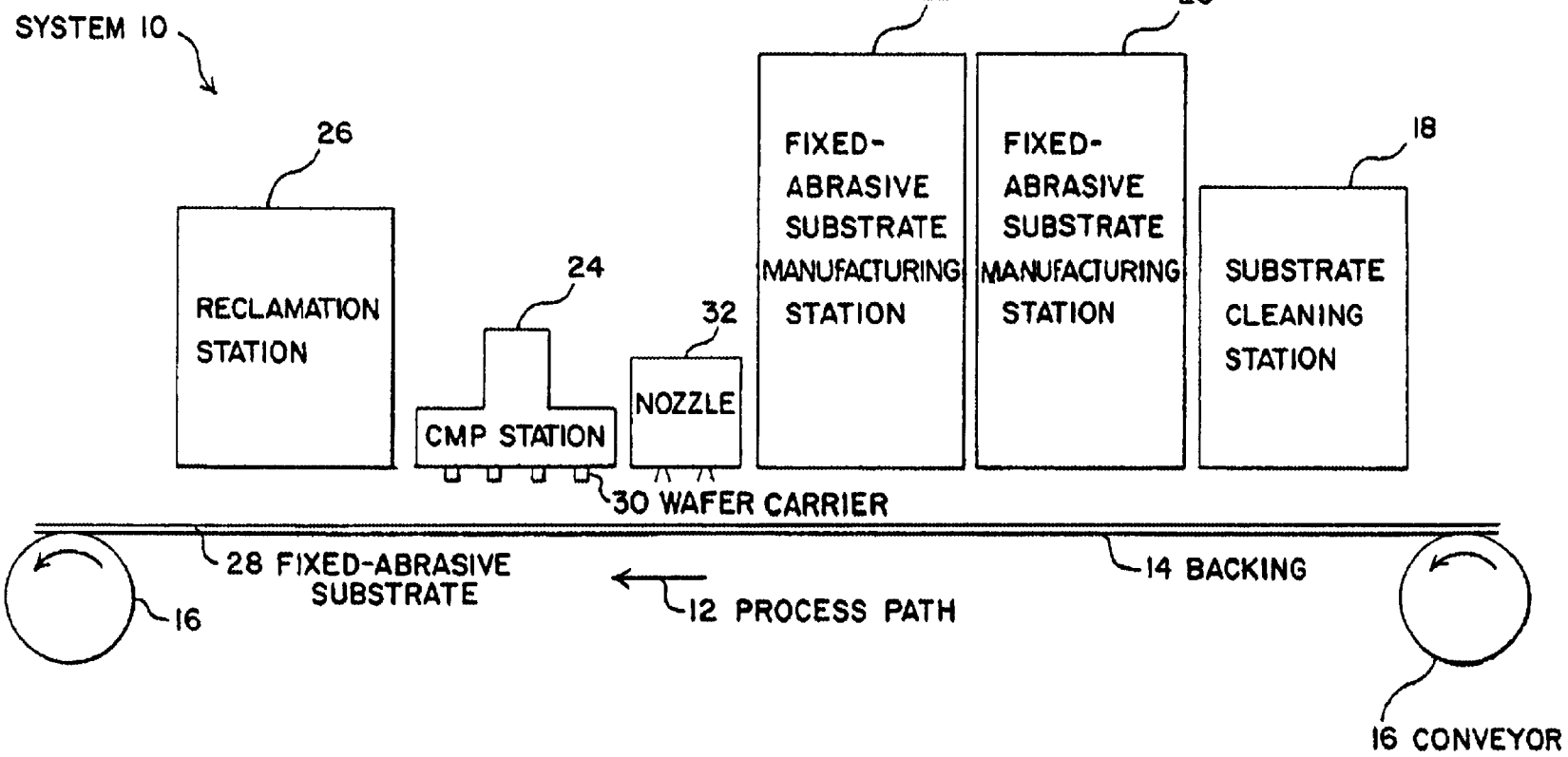
FIG. 1 illustrates a fixed-abrasive substrate manufacturing station and a chemical mechanical planarization station using a single process path.

According to a preferred embodiment of the present invention, a system is described below that provides for the manufacture of a fixed-abrasive substrate in situ, or as part of the same process path as a CMP module. A diagrammatic view of a system 10 comprising a fixed-abrasive substrate manufacturing station 20 and a chemical mechanical planarization station 24 using a single process path 12 is shown in FIG. 1. Where conventional systems rely on the use of a consumable fixed-abrasive substrate from a third party supplier for use in CMP processes, the disclosed system provides for a single process path 12 which incorporates fixed-abrasive substrate manufacturing and wafer polishing. The fixed-abrasive substrate is manufactured at one station along the process path and then used in the CMP process at a subsequent station along the process path. The disclosed system provides a method of creating a fixed abrasive substrate and simultaneously polishing a semiconductor wafer.

The system 10 is illustrated in FIG. 1. Generally, a conveyor 16 transports a substrate or backing 14 along a process path 12 from a fixed-abrasive substrate manufacturing station 20 to a wafer polishing station 24. The backing 14 is untreated as it is transported towards the fixed-abrasive substrate manufacturing station 20 where an abrasive/binding agent mixture is applied. As the backing 14 is transported along the process path 12, the treated portion of the backing 28, or the fixed-abrasive substrate 28, reaches the CMP module 24 and is used in the wafer polishing process. The term backing 14 refers specifically to the substrate or backing portion of the fixed-abrasive substrate or to untreated backing. The term or fixed-abrasive substrate 28 refers to treated backing or backing to which the abrasive/binding agent mixture has been applied.

The process path 12 generally proceeds in the following manner. The backing 14 is optionally cleaned and prepared for fixed-abrasive substrate manufacturing at a substrate cleaning station 18. The fixed abrasive is then applied to the backing 14 at a fixed-abrasive substrate manufacturing station 20. After the fixed-abrasive substrate 28 is manufactured, the conveyor 16 transports the fixed-abrasive substrate 28 to the CMP station 24 where the fixed-abrasive substrate 28 is utilized in the wafer polishing process. After the fixed-abrasive substrate 28 has been used in the CMP process, both the backing 14 and the fixed abrasive may be reclaimed or recycled at the reclamation station 26 for use in subsequent rounds of fixed-abrasive substrate manufacturing.

Depending on the type of fixed-abrasive substrate desired for a particular application, there many be more than one fixed-abrasive substrate manufacturing station 20, 22 along the process path 12 to allow for multiple rounds of fixed-abrasive application to the backing 14.

For CMP processes to effectively and efficiently polish semiconductor wafers, optimally, there is a velocity differential between the wafer and the polishing material. For most applications using a system according to the present invention, the manufacturing of the fixed-abrasive substrate proceeds at a slower rate than the wafer polishing. The fixed-abrasive substrate manufacturing may proceed at a rate of about 0.1 inch/min to about 1 inch/min. To accommodate these different rates while maintaining continuous operation of both the fixed-abrasive substrate manufacturing function and the CMP function, the wafer carrier 30 is preferably moving or rotating with respect to the conveyor as the fixed-abrasive substrate 28 is proceeding along the process path 12. It is important to maintain the velocity differential between the wafer carrier 30 and the fixed-abrasive substrate 28. The velocity differential is generally in the range of about 50 ft/min to about 400 ft/min. The fixed-abrasive substrate 28 progresses along the process path 12 at a fixed rate correlated to the rate of its production. The wafer, held in place by a wafer carrier 30 in the CMP module 24, is brought into contact with the fixed-abrasive substrate 28 and is moving or rotating with respect the fixed-abrasive substrate 28. The motion of the wafer is optimally at a rate such that the average velocity is maintained in the range of about 50 ft/min to about 400 ft/min. The path of motion of the wafer is optimally a somewhat random motion which uses substantially all of the area of the fixed-abrasive substrate 28. This type of motion provides uniform material removal from the wafer without introducing systematic defects.

Figure 2:
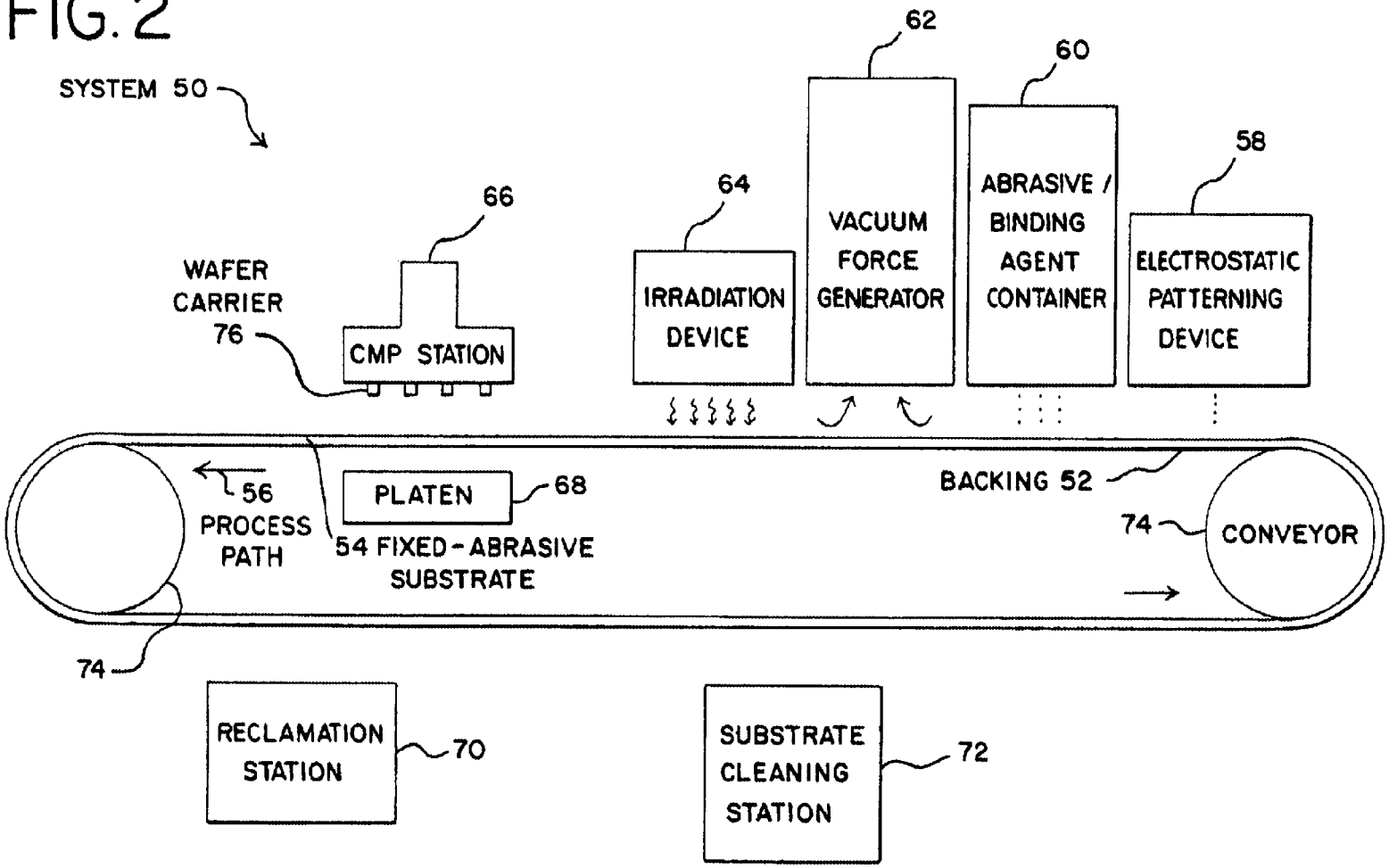
FIG. 2 illustrates one embodiment of a closed loop system.

One preferred embodiment of the present invention is shown in FIG. 2. In general, the system 50 shown in FIG. 2 is a closed loop system for fixed-abrasive substrate manufacturing and wafer polishing using a single platform, using a closed loop backing 52 which forms a complete loop that repeatedly circulates along the process path 56. Generally, the system 50 utilizes electrostatic patterning to create a pattern on the backing 52 to guide application of the abrasive/binding agent mixture. The binding agent is a polymer precursor which polymerizes on exposure to UV radiation. The system 50 also provides for the recycling or reuse of the backing 52 in multiple rounds of fixed-abrasive substrate manufacturing and wafer polishing.

A conveyor 74 controls the movement of the backing 52 along the process path 56. The conveyor 74 generally transports the backing 52 in the direction of the arrow shown in FIG. 2, but the conveyor 74 is also able to move in the reverse direction. This would allow the backing 52 to pass through multiple rounds of abrasive/binding agent mixture application from a single fixed-abrasive substrate manufacturing station. The conveyor 74 may be a beltless conveyor with the backing 52 of the fixed-abrasive substrate serving as the platform.

In the present embodiment, the fixed-abrasive substrate manufacturing station (shown as 20, 22 in FIG. 1) comprises a patterning device 58, an abrasive/binding agent container 60, an abrasive/binding agent mixture removal device 62, and an affixation device 64, as illustrated in FIG. 2.

The patterning device, in this embodiment is an electrostatic patterning device 58 which emits an electrical field. Exposure of the backing 52 to the electrical field produces an electrostatic charge of a predetermined pattern and density on the backing 52. The electrostatic patterning serves to direct the pattern of the application of the abrasive/binding agent mixture onto the backing 52. The abrasive/binding agent mixture is attracted to the areas of the backing 52 with the greatest charge density. The electrostatic patterning device 58 may be any of a number of mechanisms such as the. type commonly used in photocopiers and for electrostatic printing in which a charge is placed on the moving paper and then toner is applied to the charged areas. In this case, the charge is placed on the backing 52 and the abrasive/binding agent mixture is applied to the charged areas.

The abrasive/binding agent container 60 receives, contains, and deposits the abrasive/binding agent mixture on to the surface of the backing 52. In the present embodiment, the binding agent is a polymer precursor, such as a polyacrylate-type compound, or a polyurethane-type compound. The abrasive and the polymer precursor may be delivered into the abrasive/binding agent container 60 as a substantially homogeneous mixture of abrasive and polymer precursor. Alternatively, the components may be added separately to the abrasive/binding agent container 60 and mixed in the abrasive/binding agent container 60. The abrasive/binding agent mixture, or abrasive/polymer precursor mixture, is applied to the backing 52 from the container 60. As the abrasive-polymer precursor mixture is deposited from the container 60 to the backing 52, the mixture is attracted to the backing 52 in the pattern of the electrostatic charge on the backing 52.

The backing 52 with the abrasive/binding agent mixture applied then moves along the process path 56 and is exposed to an abrasive/binding agent mixture removal device which in the present embodiment is a vacuum force generator 62. The vacuum force generator 62 applies a vacuum pressure to remove excess abrasive/binding agent mixture from the backing 52. There may be excess abrasive mixture that is not in the pattern of the electrostatic patterning on the backing 52. This excess is removed before the abrasive mixture is fixed to the backing 52 so the abrasive is applied to the backing 52 in the pattern and density desired. One example of a vacuum force generator 62 would use a house vacuum and contain a separator to recover the reclaimed abrasive/binding agent mixture. Alternatively, the vacuum force can be provided by a stand-alone system.

The backing 52 and abrasive mixture is then exposed to an affixation device 64. In the present embodiment, the affixation device is an irradiation device 64 such as a UV laser which emits UV radiation causing the polymer precursor in the abrasive/binding agent mixture to polymerize and thereby become affixed to the backing 52. This creates the fixed-abrasive substrate 54 that is used in the polishing process.

The fixed-abrasive substrate 54 then proceeds along the process path 56, carried by the conveyor 74, to the CMP station 66 where it is used to polish semiconductor wafers. A platen assembly 68, disposed beneath the fixed-abrasive substrate 54 and opposite the wafer carrier 76, supports the substrate 54 and controls its position relative to the wafer carrier 76. Examples of CMP modules which can be used in this process are the TERES™ polishing system available from Lam Research Corp., Fremont, Calif. and the Obsidian System available from Applied Materials, Santa Clara, Calif. Examples of wafer carriers are described in U.S. Pat. Nos. 5,803,799 and 5,857,899, which are incorporated herein by reference. To accommodate the rate at which fixed-abrasive substrate can be manufactured, it is preferable to use a CMP system which rotates the wafer with respect to the fixed-abrasive substrate such as the Obsidian system.

After the fixed-abrasive substrate 54 is used in the CMP polishing process, the backing 52 and/or the abrasive can be recovered and reused to make additional fixed-abrasive substrate. The reclamation station 70 is used to remove the abrasive and binding agent from the backing 52. The reclamation station 70 may recover the abrasive particles from the abrasive/polymer mixture which is removed from the backing 52. Recovery of abrasive may occur in situ, or the abrasive/polymer mixture may be removed from the backing 52 and recovery of the abrasive may occur remotely from the process path 56. As the abrasive/polymer mixture is removed from the backing 52, it is treated with a chemical mixture that dissolves the polymer and releases the abrasive particles. Examples of chemical mixtures which could be used for reclamation include a sulfuric acid/hydrogen peroxide mixture or a solvent which dissolves the polymer matrix. The abrasive particles can then be recovered for reuse in making additional fixed-abrasive substrate.

The substrate cleaning device 72 is used to clean and prepare the backing 52 for reuse or to clean new backing for initial use. The substrate cleaning device 72 washes debris off of the new or recycled backing and clears the backing 52 of electrostatic charge or other such characteristics that could interfere with the processes of patterning or abrasive/binding agent mixture application.

As seen in FIG. 2, the present invention allows for simultaneous fixed-abrasive substrate manufacturing and wafer polishing in a single process path, wherein the acts of affixing the abrasive/binding agent mixture to a continuously moving backing and polishing the semiconductor wafer with the fixed-abrasive substrate are performed concurrently.

Figure 3:
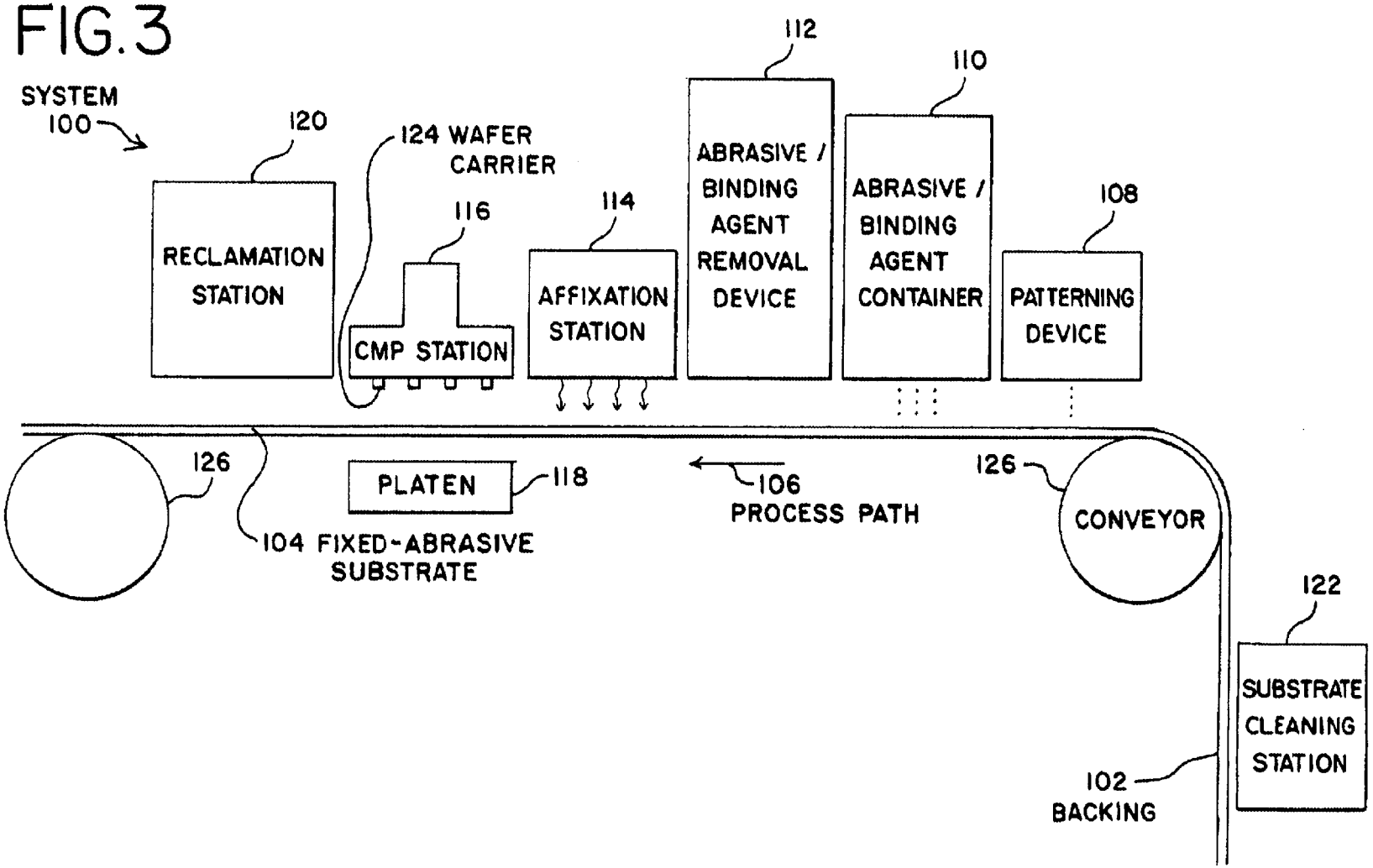
FIG. 3 illustrates an alternative embodiment of a fixed-abrasive substrate manufacturing station and a chemical mechanical planarization station using a single process path.

Another embodiment of a fixed-abrasive substrate manufacturing module and a chemical mechanical planarization module using a single platform is shown in FIG. 3. The fixed-abrasive substrate manufacturing station, shown as 20 and 22 in FIG. 1 has multiple components. The fixed-abrasive substrate manufacturing station 20 of FIG. 1 comprises the patterning device 108, the abrasive/binding agent container 110, the abrasive/binding agent mixture removal device 112, and an affixation device 114, illustrated in FIG. 3.

Referring to FIG. 3, a conveyor 126 transports the substrate or backing 102 along the process path 106. The conveyor 126 generally proceeds in the direction of the arrow shown in FIG. 3, but can be controlled to move in either direction. For example, if multiple rounds of application of abrasive to the backing 102 are necessary to produce the desired fixed-abrasive substrate, the conveyor can allow the backing 102 to proceed through one cycle of abrasive application and then reverse and proceed again for another round of abrasive application to the same portion of backing 102. Alternatively, as discussed above, another method for applying multiple layers of fixed-abrasive to the backing 102 is to include multiple fixed-abrasive application stations along the process path. (Shown as 20 and 22 in FIG. 1.)

The conveyor 126 can be a beltless conveyor. Particularly when the backing 102 used is a continuous feed roll or a closed loop, the backing 102 for the fixed-abrasive substrate can serve as the platform and no additional conveyor belt is necessary. The conveyor itself 126 comprises motorized rollers adapted to receive a backing 102. The conveyor 126 supports the backing 102 and transports the backing 102 along the process path 106.

The fixed-abrasive substrate may be produced using any type of backing 102 that can be used for a CMP process. For example, the backing 102 can be produced as a continuous feed roll, a closed loop, or as annular or round disks. For continuous feed, shown in FIG. 3, the backing 102 is a long roll that proceeds in a linear fashion along the process path 106. A closed loop backing 152, shown in FIG. 4, forms an endless belt loop that repeatedly circulates along the process path 160. Examples of materials that can be used for the backing include Keviar, polycarbonate, nylon, and polyurethane.

Referring again to FIG. 3, the backing 102, in whichever form it is produced, may be utilized as a single-use product or a multiple-use product. For multiple use, after the fixed-abrasive substrate 104 is used in a CMP process, the abrasive is removed from the backing 102, and the backing 102 is recycled and reused to make additional fixed-abrasive substrate.

In preparation for use in the fixed-abrasive substrate manufacturing process, the backing 102 is preferably cleaned by a substrate cleaning device 122. Before abrasive is applied to the backing 102, the backing 102 is cleaned to remove any debris or unwanted material. The cleaning process would also remove any electrostatic charge present on the backing 102. It is optimal to have the backing 102 processed in this manner to ensure that unwanted debris or electrical charge does not interfere with the process of abrasive application to the backing 102.

The substrate patterning device 108 is optionally used to pattern or prepare the backing 102 for application of the abrasive/binding agent mixture. For example, in one embodiment, the substrate patterning device 108 may emit an electrical field to which the backing 102 is exposed, thereby electrostatically charging the backing 102. The backing 102 is electrostatically charged with a predetermined pattern and density. The electrostatic patterning serves to attract the abrasive/binding agent mixture and to control its pattern of application to the backing 102. The pattern and density of the electrostatic charge chosen for application to the backing 102 depend on the desired pattern of abrasive on the backing 102.

In another embodiment, the substrate patterning device 108 prepares the backing 102 for application of the abrasive/binding agent mixture by applying an adhesive to the backing 102. When the abrasive/binding agent mixture is subsequently applied to the backing 102, the abrasive/binding agent mixture adheres to the adhesive.

Use of the substrate patterning device 108 is optional, and the present invention also includes embodiments in which it is not necessary to pattern the backing 102 in advance of applying the abrasive/binding agent mixture.

The abrasive/binding agent container 110 receives the abrasive/binding agent mixture, contains the abrasive/binding agent mixture, and deposits the abrasive/binding agent mixture on to the backing 102. The abrasive/binding agent container 110 may receive the abrasive/binding agent mixture in a form that is ready to be applied to the backing 102. Alternatively, the abrasive/binding agent container 110 may receive the abrasive and the binding agent separately and provide mixing of the components to produce a substantially homogeneous abrasive/binding agent mixture before it is applied to the backing 102.

In another embodiment, the abrasive/binding agent mixture is deposited on the substrate 102 in the form of a film or layer of abrasive and binding agent. The abrasive/binding agent container 110 is used to place the film or layer of abrasive and binding agent on the backing 102. As discussed in greater detail below, the film or layer of abrasive and binding agent that is placed on the backing 102 is then patterned with a laser or other source that results in the polymerization or melting of the abrasive/binding agent mixture to the backing 102.

The abrasive particles are chosen based on the process and the type of wafer being produced. The abrasive should be hard enough to withstand the polishing environment and to remove material from the wafer in the planarization process. The abrasive should, however, be soft enough so it does not damage the surface of the wafer being polished. Abrasive particles commonly used in CMP polishing systems include aluminum oxide, cerium oxide, manganese oxide, silica, and diamond.

The binding agent is the material in which the abrasive is suspended and which causes the abrasive to become affixed to the backing 102. The binding agent may be a polymer, a polymer precursor, or any other agent that causes the abrasive to become affixed to the backing 102. Examples of binding agents may include acrylate or other polyester-type compounds, and various other polymers such as those available from Norton, a division of Saint-Gobain Industrial Ceramics Inc., Latrobe, Pa. In the case of a polymer precursor, polymerization of the precursor occurs upon exposure to some environmental condition. For example, different types of polymer precursors may polymerize when exposed to ultraviolet radiation (UV), infrared radiation (IR), laser light, or heat.

The abrasive/binding agent mixture is optimally chosen so it is able to self-dress. Abrasive is distributed homogeneously in the binding agent or matrix. The surface of the fixed-abrasive substrate wears smooth as it contacts a semiconductor wafer during polishing. As the surface of the fixed-abrasive substrate is smoothed, there is a need to expose more abrasive. Self-dressing is the act of exposing abrasive on the surface of the polishing member as a result of the polishing process.

The abrasive/binding agent removal device 112 removes excess abrasive/binding agent mixture from the backing 102 before the abrasive/binding agent mixture is affixed to the backing 102. One example of an abrasive/binding agent removal device 112 is a vacuum force generator. A vacuum force generator may be used with a separator to gather the excess unbound abrasive/binding agent mixture. Alternative types of abrasive/binding agent removal device 112 include air or other compressed gas blow-off methods. The blower is used to force air over the surface of the wafer, thereby removing unbound abrasive/binding agent mixture. A blower may be used with a catcher adapted to gather the excess unbound abrasive/binding agent mixture.

The affixation device 114 exposes the backing 102 to appropriate conditions which cause the binding agent to become affixed to the backing 102. In one embodiment, the affixation device provides UV irradiation, such as a UV laser as discussed above. In the case where the abrasive/binding agent mixture is applied as a sheet or layer to the backing 102, the abrasive/binding agent mixture is not pre-patterned because a blanket application is used rather than the electrostatic method, for example. For a blanket application, the affixation device 114 preferably creates the pattern desired on the fixed-abrasive substrate. For example, the affixation device 114 may be a UV source which uses photomasking techniques to generate a pattern in the abrasive/binding agent mixture.

The binding agent may become affixed to the backing 102 by polymerization or by melting on to the backing 102. For example, where the binding agent used is a polymer precursor, the irradiation device exposes the applied abrasive-polymer precursor mixture to the appropriate conditions to cause polymerization of the polymer precursor and affixation of the abrasive-polymer mixture to the backing 102, thereby creating the fixed-abrasive substrate 104. Such polymerization conditions may include, for example, exposure to ultraviolet radiation (UV), infrared radiation (IR), laser light, or heat.

The chemical mechanical planarization (CMP) system 116, or wafer polisher, is used to planarize or polish semiconductor wafers. According to the present invention, the CMP system 116 is "in line" with the fixed-abrasive substrate manufacturing system as part of a single process path 106. A platen assembly 118, is positioned beneath the fixed-abrasive substrate 104 and opposite the wafer carrier 124, and supports the substrate and controls its position relative to the wafer carrier. Examples of a CMP modules which can be used in this process are the TERES™ polishing system available from Lam Research Corp., Freemont, Calif. and the Obsidian System from Applied Materials, Santa Clara, Calif.

Figure 4:
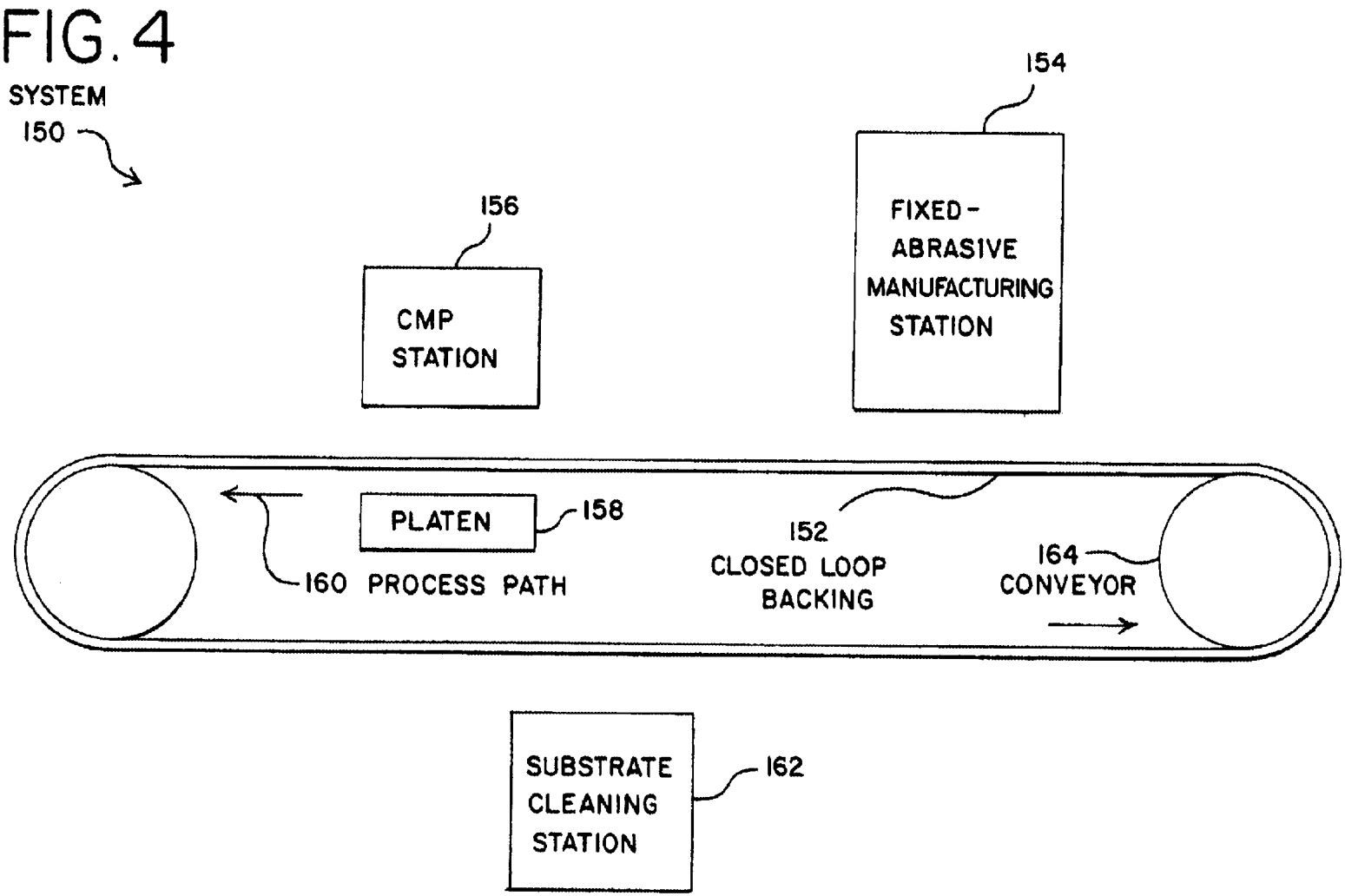
FIG. 4 illustrates an alternative embodiment of a system using a closed loop substrate.

FIG. 4 illustrates an embodiment of the present invention with a closed loop backing 152. The closed loop backing 152 forms a complete loop that repeatedly circulates along the process path. In one embodiment of a closed loop system, the closed loop backing 152 is used for multiple rounds of fixed-abrasive substrate production and CMP processing. Between successive rounds of fixed-abrasive substrate production and CMP processing, the substrate cleaning device 162 cleans the backing 152 of the fixed-abrasive substrate. The backing 152 is cleaned by removing the abrasive/binding agent mixture that had been affixed to the backing 152, or by otherwise treating the used fixed-abrasive substrate so that additional abrasive/binding agent mixture can be applied.

The closed loop embodiment shown in FIG. 4 allows continuous operation of the wafer polishing system. Fixed-abrasive substrate is continuously regenerated and supplied for use in the CMP module.

Although not required, each of the above embodiments described herein may utilize a non-abrasive liquid during polishing, such as deionized water, to facilitate the polishing process. The non-abrasive liquid may be applied via nozzles 32 (see FIG. 1) to the region of the fixed-abrasive substrate intended for contact with a wafer.

There has been disclosed in accordance with the present invention, a method and apparatus for fixed-abrasive substrate manufacturing and wafer polishing using a single process path. Although the invention has been described and illustrated with reference to specific illustrative embodiments thereof, it is not intended that the invention be limited to those illustrative embodiments. Those skilled in the art will recognize that variations and modifications can be made without departing from the spirit of the invention. It is therefore intended to include within the invention all such variations and modifications that fall within the scope of the appended claims and equivalents thereof.

I claim:

1. An apparatus for polishing a semiconductor wafer comprising:

a conveyor adapted to transport a backing along a process path;

a patterning device, the patterning device designed to apply a pattern on to the backing to guide deposition of an abrasive on to the backing;

a first container positioned along the process path and adjacent to the patterning device, the first container designed to deposit an abrasive/binding agent mixture onto the backing;

an affixation station positioned along the process path and downstream from the first container, the affixation station configured to expose a backing upon which abrasive/binding agent mixture has been deposited to conditions which cause the abrasive/binding agent mixture to become affixed to the backing thereby creating a fixed-abrasive substrate; and a wafer polishing station positioned along the process path and downstream from the affixation station, the wafer polishing station comprising a wafer carrier assembly for supporting a semiconductor wafer and for transporting the wafer toward the substrate such that the wafer contacts the surface of the fixed abrasive substrate, and a substrate support disposed beneath the fixed-abrasive substrate and opposite the wafer carrier.

2. An apparatus according to claim 1 wherein the patterning device applies an electrostatic charge of predetermined pattern and density on to the backing.

3. An apparatus according to claim 1 wherein the patterning device applies an adhesive to the backing.

4. An apparatus according to claim 1 wherein the affixation station emits ultraviolet radiation.

5. An apparatus according to claim 4 wherein the affixation station comprises a UV laser.

6. An apparatus according to claim 4 wherein the affixation station comprises a UV photomasking device.

7. An apparatus according to claim 1 wherein the affixation station emits infrared radiation.

8. An apparatus according to claim 1 wherein the affixation station emits heat.

9. An apparatus according to claim 1 further comprising an abrasive/binding agent removal station positioned along the process path and adjacent to the first container, the removal station designed to remove excess abrasive/binding agent mixture from the surface of the backing.

10. An apparatus according to claim 9 wherein the abrasive/binding agent removal station comprises a vacuum force generator.

11. An apparatus according to claim 9 wherein the abrasive/binding agent removal station comprises a compressed gas blower.

12. An apparatus for polishing a semiconductor wafer comprising:

a conveyor adapted to transport a backing along a process path;

an electrostatic patterning device, the electrostatic patterning device designed to apply an electrostatic field of predetermined pattern and density onto the backing;

a first container positioned along the process path and adjacent to the electrostatic patterning device, the first container designed to deposit an abrasive/binding agent mixture onto the backing;

a polymerization station positioned along the process path and downstream from the first container, the polymerization station configured to expose a backing upon which abrasive/binding agent mixture has been deposited to conditions which cause the abrasive/binding agent mixture to become affixed to the backing and creating a fixed-abrasive substrate; and a wafer polishing station positioned along the process path and downstream from the polymerization station, the wafer polishing station comprising a wafer carrier assembly for supporting a semiconductor wafer and for transporting the wafer toward the substrate such that the wafer contacts the surface of the fixed abrasive substrate, and a substrate support disposed beneath the fixed-abrasive substrate and opposite the wafer carrier.

13. An apparatus according to claim 12 further comprising an abrasive/binding agent removal station positioned along the process path and adjacent to the first container, the removal station having a vacuum force generator designed to apply a vacuum force to remove excess abrasive/binding agent mixture from the surface of the backing.

* * * * *